US007401898B2

(12) United States Patent
Powers

(10) Patent No.: US 7,401,898 B2
(45) Date of Patent: Jul. 22, 2008

(54) INK JET PRINT HEAD ADAPTED TO MINIMIZE ORIENTATION-INDUCED LINE-WIDTH VARIATION

(75) Inventor: James Harold Powers, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 380 days.

(21) Appl. No.: 11/322,868

(22) Filed: Dec. 30, 2005

(65) Prior Publication Data

US 2007/0153054 A1 Jul. 5, 2007

(51) Int. Cl.
*B41J 2/14* (2006.01)

(52) U.S. Cl. ..... 347/47

(58) Field of Classification Search ..... 347/45, 347/47

See application file for complete search history.

(56) References Cited

U.S. PATENT DOCUMENTS

| | | | | |
|---|---|---|---|---|
| 6,010,208 | A * | 1/2000 | Powers et al. | 347/65 |
| 6,045,214 | A * | 4/2000 | Murthy et al. | 347/47 |
| 2004/0052569 | A1 | 3/2004 | Bich et al. | |

* cited by examiner

*Primary Examiner*—An H Do
(74) *Attorney, Agent, or Firm*—Dinsmore & Shohl, LLP

(57) ABSTRACT

Ink jet print head adapted to minimize orientation-induced line-width variation. The print head having n+1 nozzles. The n nozzles are located at vertices of a polygon having an average side length $s_{avg}$ and one nozzle located at a center of the polygon. Each side length of the polygon is less than 20% deviation from the average side length $s_{avg}$. The n+1 nozzles are configured to ink jet a line having a line-width w; and each of the n+1 nozzles is configured to ink jet a spot having an average area-equivalent spot diameter d which satisfies the inequality conditions (I)

$$0.7w \leqq d+(n/\pi)s_{avg} \leqq 1.3w. \quad \text{(I)}$$

20 Claims, 2 Drawing Sheets

INK JET PRINT HEAD ADAPTED TO MINIMIZE ORIENTATION-INDUCED LINE-WIDTH VARIATION

CROSS-REFERENCE TO CO-PENDING APPLICATION

Various methods, systems and apparatus relating to the present invention are disclosed in a co-pending U.S. Patent Application that is filed contemporaneously with this application, on Dec. 30, 2005, by the same inventor and assignee (hereafter sometimes referred to as the "Powers Co-Pending Patent Application"). The Powers Co-Pending Patent Application bears the title "INK JET PRINT HEAD ADAPTED TO MINIMIZE ORIENTATION-INDUCED LINE-WIDTH VARIATION" and the contents of that application are hereby incorporated by reference.

TECHNICAL FIELD

The present invention relates to a hand-held ink jet pen, and more specifically to a unique heater/nozzle configuration on a print head for an orientation-tolerant ink jet pen.

BACKGROUND OF THE INVENTION

The conventional writing pen is well-known in the art. One of the primary characteristics of the established design of a writing pen is that the pen tip is visible to the user. This allows the user to visually connect his writings to each other. Recently, ink jet print technology has been incorporated into a pen to form a hand-held ink jet pen. Ink jet printing is a conventional technique by which printing is accomplished without contact between the print head and a substrate or medium, on which the desired print characters are deposited. Such printing is accomplished by ejecting ink from the ink jet print head of the ink jet pen via numerous methods which employ, for example, pressurized nozzles, electrostatic fields, piezo-electric elements and/or heaters for driving liquid to vapor-phase change droplet formation. Some of the hand-held ink jet pens of the prior art have employed a measurement means for measuring, without physical contact, the distance between the print head and the substrate. The measurement means is typically connected to a processor unit which is adapted to cause the ink jet system to be activated when the measurement means determines that the distance between the ink jet print head and the substrate is less than a predetermined maximum value and simultaneously a movement detector detects movement of the ink jet pen. However, such sensors require additional space that can depart from the conventional pen shape that a user has been so comfortable with over the years. As such, space is limited and places a constraint on the number of electrical sensors and connections that can be placed inside the physical constraints of the ink jet pen.

In the case of a traditional writing pen, line-width is a primary descriptor by which the customer makes his choice. Line-width is typically specified either directly in millimeters or by such adjectives as "bold", "medium", "fine", or "extra-fine", each with a specified meaning within the industry. Line-widths of 0.200, 0.300 and 0.500 millimeters are industry standards; although such descriptions apply directly only for a particular ink and paper combination and a particular pen tip speed. As such, when designing a print head, some of the technical challenges include determining the optimum number of heaters and nozzles, optimal spacial configurations and corresponding optimal spot size so as to achieve a specified line-width with a minimum of variation.

Line-width variation can come from multiple sources. These sources include: 1) variations in surface and absorption properties of the print media. These typically occur in media from different sources or even from a single unit from the same source; 2) variations in environment, particularly in temperature and humidity. These cause variations in the moisture content of the print medium and thereby lead to variations in ink absorptive properties; 3) variations in drop mass and jet velocity caused by variations in reservoir back pressure, heater conditions, etc.; and 4) variation in the user's manner of holding and moving the pen.

The first three sources are well-known to those skilled in the art of traditional ink jet technology. The fourth listed source of variation (the user manner of holding and moving the pen) is unique to the hand-held ink jet writing pen. As such, there is a need for a hand-held ink jet pen having a print head configured to minimize variations in line-width due to orientation of the ink jet pen. Accordingly, improved ink jet pens are desired.

SUMMARY OF THE INVENTION

The present invention relates to an ink jet pen having a print head that has a nozzle configuration adapted to minimize orientation-induced line-width errors. One aspect of the present invention is an ink jet print head for an ink jet pen. The print head comprises n+1 nozzles, wherein n nozzles are located at vertices of a polygon having an average side length $s_{avg}$ and one nozzle is located inside the polygon boundary. Each side length of the polygon is less than 20% deviation from the average side length $s_{avg}$. The n+1 nozzles are configured to ink jet a line having a line-width w. Each of the n+1 nozzles is configured to ink jet a spot having an average area-equivalent spot diameter d which satisfies the inequality conditions (I)

$$0.7w \leqq d+(n/\pi)s_{avg} \leqq 1.3w \quad \text{(I)}.$$

Another aspect of the present invention is an ink jet print head adapted to minimize orientation-induced line-width variation. The ink jet print head comprises n+1 nozzles, wherein the n+1 nozzles are configured to ink jet a line having a line-width w. The n nozzles are located at vertices of a polygon having an average side length $s_{avg}$ and one nozzle is located inside the polygon boundary. Each side length of the polygon is less than 20% deviation from the average side length $s_{avg}$. Each of the n+1 nozzles is configured to ink jet a spot having an average area-equivalent spot diameter d which satisfies the inequality conditions (IIa, IIb, IIc) with coefficient $\lambda=1.3$:

$$\tfrac{1}{2}s_{avg}\csc(\pi/n) \leqq d \leqq \lambda s_{avg} \text{ when } n=2, 3, 4 \quad \text{(IIa)},$$

$$\tfrac{1}{2}s_{avg}\cot(\pi/n) \leqq d \leqq \lambda s_{avg} \text{ when } n=5, 6 \quad \text{(IIb)},$$

and $$\tfrac{1}{2}s_{avg}\cot(\pi/n) \leqq d \leqq \tfrac{1}{2}\lambda s_{avg}\csc(\pi/n) \text{ when } n=7, 8, 9, \quad \text{(IIc)}.$$

Yet another aspect of the present invention is an ink jet print head adapted to minimize orientation-induced line-width variation. The ink jet print head comprises n+1 nozzles, wherein the n+1 nozzles are configured to ink jet a line having a line-width w. The n nozzles are located at vertices of a polygon having an average side length $s_{avg}$ and one nozzle is located at a center of the polygon. Each side length of the polygon is less than 20% deviation from the average side length $s_{avg}$. The n+1 nozzles are configured to ink jet a polygonal array of ink spots having an average area-equivalent spot diameter d which satisfies the inequality conditions (IIIa, IIIb, IIIc) with coefficient $\lambda=1.3$:

$$w/[1+(2n/\pi)\sin(\pi/n)]\leq d\leq\lambda w/[\lambda+n/\pi],\ \text{where } n=2, 3, 4 \quad \text{(IIIa)},$$

$$w/[1+(2n/\pi)\tan(\pi/n)]\leq d\leq\lambda w/[\lambda+n/\pi],\ \text{where } n=5, 6 \quad \text{(IIIb)},$$

and $$w/[1+(2n/\pi)\tan(\pi/n)]\leq d\leq\lambda w/[\lambda+(2n/\pi)\sin(\pi/n)],\ \text{where } n=7, 8, 9, \quad \text{(IIIc)},$$

Another aspect of the present invention is an ink jet print head adapted to minimize orientation-induced line-width variation. The ink jet print head comprises n+1 nozzles, wherein n nozzles are located at vertices of a polygon having an average side length $s_{avg}$ and one nozzle is located inside the polygon boundary. Each side length of the polygon is less than 20% deviation from the average side length $s_{avg}$ which satisfy the inequality conditions (IVa, IVb, IVc) with coefficient $\lambda=1.3$:

$$w/[\lambda+n/\pi]\leq s_{avg}\leq 2w\sin(\pi/n)/[1+(2n/\pi)\sin(\pi/n)],\ \text{where } n=2, 3, 4 \quad \text{(IVa)},$$

$$w/[\lambda+n/\pi]\leq s_{avg}\leq 2w\tan(\pi/n)/[1+(2n/\pi)\tan(\pi/n)],\ \text{where } n=5, 6 \quad \text{(IVb)},$$

and $$2w\sin(\pi/n)/[\lambda+(2n/\pi)\sin(\pi/n)]\leq s_{avg}\leq 2w\tan(\pi/n)/[1+(2n/\pi)\tan(\pi/n)],\ \text{where } n=7, 8, 9, \quad \text{(IVc)}.$$

Yet still another aspect of the present invention is an ink jet print head adapted to minimize orientation-induced line-width variation. The ink jet print head comprises n+1 nozzles, wherein n nozzles are located at vertices of a polygon having an average side length $s_{avg}$ and one nozzle is located inside the polygon boundary. Each side length of the polygon is less than 20% deviation from the average side length $s_{avg}$. Each of the n+1 nozzles is configured to ink jet a line having a line width w which satisfies the inequality conditions (Va, Vb, Vc) with coefficient $\lambda=1.3$:

$$[n/\pi+\tfrac{1}{2}\csc(\pi/n)]s_{avg}\leq w\leq[\lambda+n/\pi]s_{avg},\ \text{where } n=2, 3, 4 \quad \text{(Va)},$$

$$[n/\pi+\tfrac{1}{2}\cot(\pi/n)]s_{avg}\leq w\leq[\lambda+n/\pi]s_{avg},\ \text{where } n=5, 6 \quad \text{(Vb)},$$

and $$[n/\pi+\tfrac{1}{2}\cot(\pi/n)]s_{avg}\leq w\leq[n/\pi+\tfrac{1}{2}\lambda\csc(\pi/n)]s_{avg},\ \text{where } n=7, 8, 9, \quad \text{(Vc)},$$

Another aspect of the present invention is an ink jet print head adapted to minimize orientation-induced line-width variation. The ink jet print head comprises n+1 nozzles, wherein n nozzles are located at vertices of a polygon having an average side length $s_{avg}$ and one nozzle is located inside the polygon boundary and configured for ink jetting a polygonal array of ink spots having an average area-equivalent spot diameter d. Each side length of the polygon is less than 20% deviation from the average side length $s_{avg}$ which satisfy the inequality conditions (VIa, VIb, VIc) with coefficient $\lambda=1.3$:

$$d/\lambda\leq s_{avg}\leq 2d\sin(\pi/n),\ \text{where } n=2, 3, 4 \quad \text{(VIa)},$$

$$d/\lambda\leq s_{avg}\leq 2d\tan(\pi/n),\ \text{where } n=5, 6 \quad \text{(VIb)},$$

and $$(2d/\lambda)\sin(\pi/n)\leq s_{avg}\leq 2d\tan(\pi/n),\ \text{where } n=7, 8, 9, \quad \text{(VIc)}.$$

Still another aspect of the present invention is an ink jet print head adapted to minimize orientation-induced line-width variation. The ink jet print head comprises n+1 nozzles, wherein n nozzles are located at vertices of a polygon having an average side length $s_{avg}$ and one nozzle is located inside the polygon boundary. Each side length of the polygon is less than 20% deviation from the average side length $s_{avg}$; and configured for ink jetting a polygonal array of ink spots having an average area-equivalent spot diameter d. Each of the n+1 nozzles is configured to ink jet a line having a line width w which satisfies the inequality conditions (VIIa, VIIb, VIIc) with coefficient $\lambda=1.3$:

$$[1+(n/\pi\lambda)]d\leq w\leq[1+(2n/\pi)\sin(\pi/n)]d,\ \text{where } n=2, 3, 4 \quad \text{(VIIa)},$$

$$[1+(n/\pi\lambda)]d\leq w\leq[1+(2n/\pi)\tan(\pi/n)]d,\ \text{where } n=5, 6 \quad \text{(VIIb)},$$

and $$[1+(2n/\pi)\sin(\pi/n)]d\leq w\leq[1+(2n/\pi)\tan(\pi/n)]d,\ \text{where } n=7, 8, 9, \quad \text{(VIIc)},$$

The ink jet print heads of the present invention are advantageous for providing an ink jet pen having minimized orientation-induced line-width variations. These and additional advantages will be apparent in view of the detailed description.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

Figure 1A:
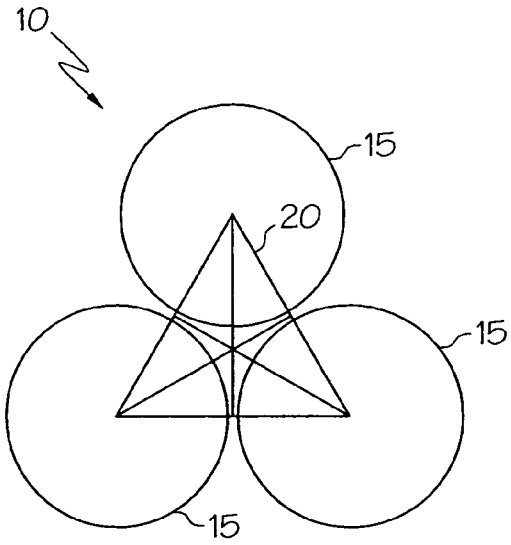
FIG. 1 is a schematic illustration of spot patterns created by exemplary nozzle configurations according to a first embodiment of the present invention.

The embodiments set forth in the drawings are illustrative in nature and not intended to be limiting of the invention defined by the claims. Moreover, individual features of the drawings and the invention will be more fully apparent and understood in view of the detailed description.

DETAILED DESCRIPTION OF THE EXEMPLARY EMBODIMENTS OF THE INVENTION

In one exemplary embodiment of the present invention, an ink jet print head is adapted to minimize orientation-induced line-width variations in a hand-held ink jet pen. The orientation of the pen with respect to paper and line-scan direction can be characterized by two angles:

The angle $\tau$ describes the tilt angle between a perpendicular to the plane of the paper and the pen barrel.

The angle $\theta$ describes the rotational angle between the line-scan direction and a principle axis of the nozzle array.

The rotational orientation of the nozzle array with respect to the line-scan direction is particularly important. To better understand this point, imagine a hand-held pen with two nozzles. If the nozzles are initially perpendicular to the line-scan direction, then, neglecting surface tension effects, a ninety-degree rotation of the pen barrel causes a difference in line-width on the order of the nozzle spacing.

One exemplary embodiment of the present invention comprises an ink jet pen having heaters and nozzles placed at the vertices of regular polygons. One main reason for contemplating regular polygons rises from classical geometry: among all general polygons with a fixed number of vertices, those with the least difference between minimum and maximum widths are the regular ones.

In an alternative embodiment of the present invention, heaters and nozzles are placed at the vertices of quasi-regular polygons. By quasi-regular polygon it is meant that each side length of the polygon deviates less than 30% from the average side length.

Conceptually, the most elegant solution would appear to be a single nozzle. The enabling structures (heaters, flow features, nozzle, ink vias, etc.) occupy the least space on the heater chip and line-width has no rotational dependence whatever. However, unless the desired line-width is quite thin, the single-nozzle solution may encounter considerable difficulties due to the size of the required ink drop.

One is therefore led to consider two-nozzle configurations. These suffer from the particularly severe rotational dependence described above; nevertheless, given a target line-width, it is reasonable to seek an optimal relationship between nozzle spacing and spot size—one for which the variation in line-width is minimized.

Similar considerations apply to nozzles arrayed at the vertices of an equilateral triangle, a square, or any regular polygon.

Nozzle Arrangement: Mathematical Framework

Glossary of Terms and Symbols:

w . . . prescribed target line-width n . . . number of nozzles located at the vertices of a regular or quasi-regular polygon, $\phi(n)$ . . . polar half-angle; i.e., half the angle subtended by adjacent nozzles located at the vertices of a polygon $\psi(n)$ . . . rotational symmetry half-angle, defined below $\theta$ . . . plane rotational angle, with reference to the pen tip scan direction R . . . radius of the circle circumscribing the regular polygon $\tau$ . . . tilt angle between the pen barrel and a perpendicular to the plane of the print medium s . . . side length of the regular or quasi-regular polygon t . . . radius of the circle inscribed in the regular polygon $h(\theta)=h(\theta; R, n)$ . . . width of the polygon with respect to pen tip scan direction, expressed as a function of the rotation angle $h^*(R, n)$ . . . mean polygon width, further described below $h_{min}(R, n)$ . . . minimum width of a regular polygon under rotation $h_{max}(R, n)$ . . . maximum width of a regular polygon under rotation $\delta(n)$ . . . dimensionless difference between $h_{max}(R, n)$ and $h_{min}(R, n)$, normalized to the diameter 2R of the circumscribing circle q . . . number of ejectors whose centers lie inside the boundary of a polygon with n vertices; in the case where the polygon is regular, these ejectors lie inside its circumscribing circle d . . . printed spot diameter—diameter of an area-equivalent circle M . . . drop mass required to form a spot of area-equivalent diameter d (on a particular medium)

$\kappa$ . . . coefficient in the drop-to-spot power law (discussed below)

$\gamma$ . . . exponent in the drop-to-spot power law (discussed below)

We shall compare certain quantities determined by the ejector count n+q and by a prescribed parameter—such as the line width w. On these occasions, we employ the following notation, or variants derived therefrom.

$C(n, q)=C(n, q; w)$ . . . ejector configuration with n ejectors placed at each vertex of a regular polygon and with q ejectors placed interior to the circle circumscribing said polygon.

d(n, q) . . . printed spot diameter, corresponding to the C(n, q; w ) configuration $d_{min}(n, q)$ . . . minimum spot diameter required to print a line of width w without gaps $d^*=d^*(n, q)$ . . . geometrically determined 'soft' maximum spot diameter; beyond which ink mass becomes excessive $\lambda$ . . . maximum spot diameter oversize ratio; that is, the experimentally determined maximum recommended value of the ratio $d/d^*$ $d_{max}(n, q)$ . . . maximum spot diameter; beyond which ink mass becomes so large as to cause unacceptable line quality K(n, q) . . . total spot area of n+q spots of diameter d(n, q)

M(n, q) . . . single-ejector (average) drop mass from n+q ejectors

Standard notations for trigonometric functions are employed: for an arbitrary angle $\theta$, $\sin\theta$, $\cos\theta$, $\tan\theta$, $\csc\theta$, $\sec\theta$ and $\cot\theta$ denote the sine, cosine, tangent, cosecant, secant, and cotangent functions of the angle $\theta$.

The Powers Co-Pending Patent Application (described in the Cross-Reference to Co-Pending Application) addresses a subset of issues related to printing applications sensitive to the printhead's rotational orientation with respect to the scan direction. There we established the general advantages of regular polygons and recorded formulae for the optimal placement of ejectors at their vertices. Now we consider the relative merits of various polygonal ejector configurations consistent with the rules established in '0357'—relating spot diameter d to the dimensions of the regular polygon. These rules can be summarized as follows:

$$h^*(R, n)=2R(n/\pi)\sin(\pi/n),$$

$$d+h^*(R, n)=w.$$

These two relationships must be augmented by well-known formulae relating the side length s of a regular polygon of n vertices, the radius R of its circumscribing circle and the radius t of its inscribed circle:

$$s=2R\sin(\pi/n),$$

$$t=R\cos(\pi/n).$$

Figure 1B:
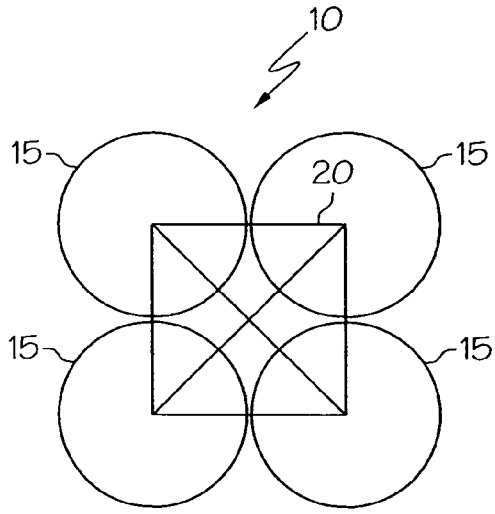
Figure 1C:
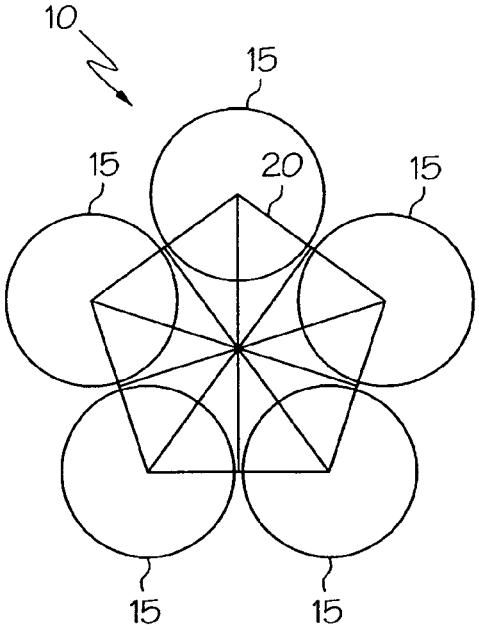
Figure 1D:
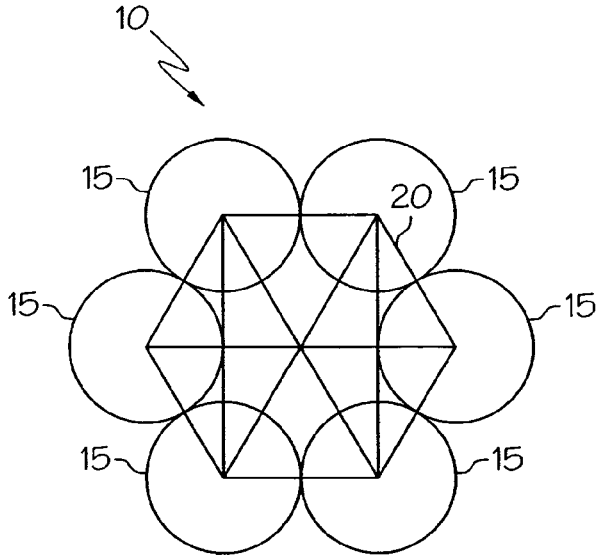
Figure 2A:
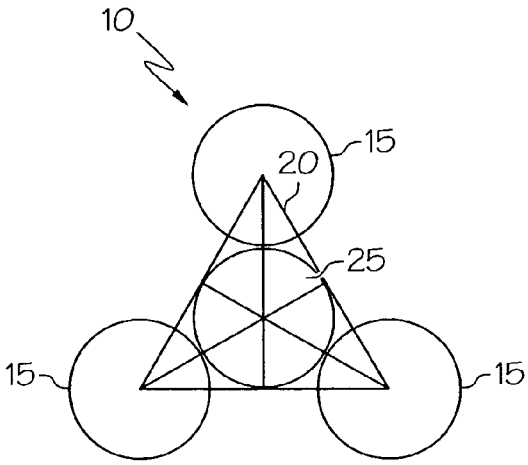
FIG. 2 is a schematic illustration of spot patterns created by exemplary nozzle configurations according to a second embodiment of the present invention.
Figure 2B:
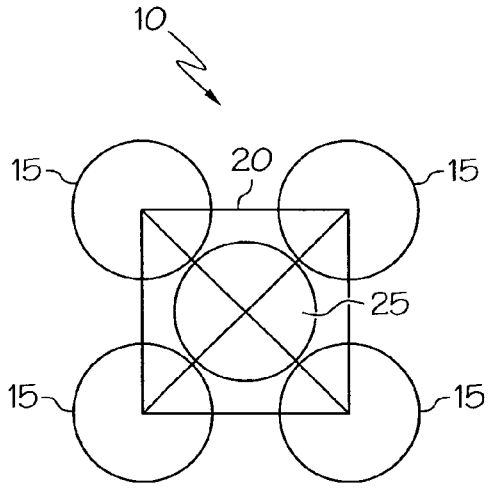
Figure 2C:
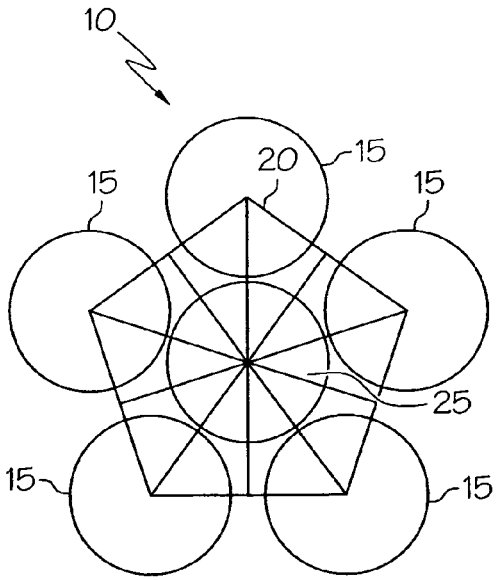
Figure 2D:
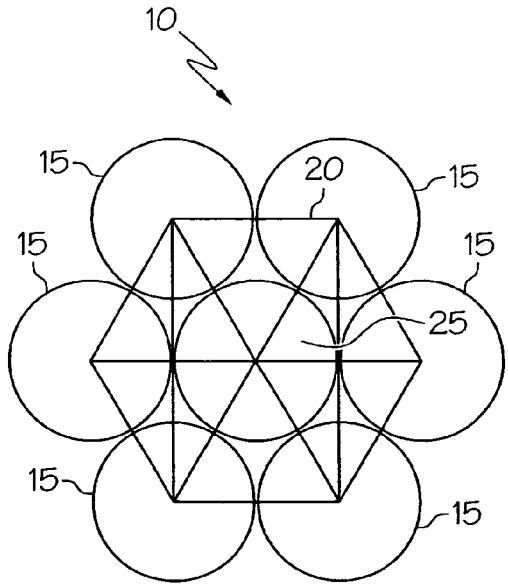

The ejector configurations described below fall into two basic categories, both of which include n ejectors configured at the vertices of a regular polygon. The distinguishing factor between the two categories is whether or not q additional ejectors lie within the polygon's circumscribing circle. The Powers Co-Pending Patent Application described the case of no interior ejectors; i.e., q=0. FIG. 1 discloses exemplary nozzle configurations 10 for low n examples with q=0. In this embodiment, n ejectors 15 are located at the vertices of a regular polygon 20. In this case, the overlap considerations recorded in the Powers Co-Pending Patent Application apply unchanged. The present invention comprises the case where q>0; in one exemplary embodiment where q=1. FIG. 2 discloses exemplary nozzle configurations 10 for low n examples with q=1. In this embodiment n ejectors 15 are located at the vertices of a regular polygon 20 and one ejector 25 is located inside the regular polygon 20 boundary.

Among possible ejector configurations, placement at the vertices of a regular polygon with an odd number of vertices enjoys a particular advantage with respect to minimizing line width variations due to pen rotation. An adequate description of this observation requires construction of additional mathematical framework; to this end, we recall the definition of $\psi(n)$, the rotational symmetry half-angle. This angle describes the periodicity inherent in the polygon width function $h(\theta)$:

$$\Psi(n) = \begin{cases} \pi/n & \text{for } n = 2, 4, 6, 8, \ldots \\ \pi/2n & \text{for } n = 3, 5, 7, 9, \ldots \end{cases}$$

Second, recall the function $\beta(n)$, which describes the diagonal width of a regular polygon inscribed in a circle of unit diameter:

$$\beta(n) = \begin{cases} 1 & \text{for } n = 2, 4, 6, \ldots \\ \cos\Psi(n) & \text{for } n = 3, 5, 7, \ldots \end{cases}$$

The polygon width function $h(\theta)$ can then be defined on the interval $-\psi(n) \leqq \theta \leqq \psi(n)$ and extended as an even periodic function of $\theta$:

$$h(\theta)=h(\theta; R, n)=2R\beta(n)\cos\theta, -\pi \leqq \theta \leqq +\pi.$$

The minimum and maximum values of the function $h(\theta)$ can be defined by:

$$h_{min}(R, n)=\min\{h(\theta)|-\pi \leqq \theta \leqq +\pi\},$$

$$h_{max}(R, n)=\max\{h(\theta)|-\pi \leqq \theta \leqq +\pi\}.$$

These can be described explicitly as follows:

$$h_{min}(R, n)=2R\beta(n)\cos\psi(n) \text{ for } n=2, 3, 4,$$

$$h_{max}(R, n)=2R\beta(n) \text{ for } n=2, 3, 4,$$

Finally, we can define a function $\delta(n)$ to measure the total variation of polygon width over the interval $-\pi \leqq \theta \leqq +\pi$. The measure $\delta(n)$ is just the difference between maximum and minimum polygon widths normalized by the diameter 2R of their circumscribed circle:

$$\begin{aligned} \delta(n) &= [h_{\max}(R, n) - h_{\min}(R, n)]/2R, \\ &= \beta(n)[1 - \cos\Psi(n)] \\ n &= 2, 3, 4, \ldots \end{aligned}$$

Two corollaries follow directly from this formula. First, we see that $$\delta(n+2)<\delta(n) \text{ for all } n=2, 3, 4,$$

This is not surprising. Of more interest is the fact that $$\delta(n)/\delta(2n)=\cos(\pi/2n)<1 \text{ for } n=3, 5, 7,$$

From the standpoint of line width variation due to pen body rotation, we see that for any odd n, ejectors configured at the vertices of a regular polygon suffer less variation than do those for even numbers of ejectors $\leqq 2n$. One particular exemplary example is n=3:

$$\delta(3)/\delta(4)=\sqrt{3}/2\times(1-\sqrt{3}/2)(1-\sqrt{2}/2)\cong 0.396,$$

$$\delta(3)/\delta(6)=\cos(\pi/6)=\sqrt{3}/2\cong 0.866.$$

Hence, three ejectors configured at the vertices of an equilateral triangle suffer less line width variation than do four ejectors configured in a square, or six ejectors configured in a regular hexagon. Similarly, five ejectors configured in a regular pentagon suffer less line width variation than do regular polygonal configurations with six, eight or ten ejectors. The general advantage of odd-numbered over even-numbered polygons is illustrated in Table 3 and Table 4.

The advantage of configurations with three ejectors over four or six comes as a unexpected surprise—as does the advantage of five ejectors over six, eight or ten. These observations and their natural generalization suggest claims of invention as follows:

A configuration of three ejectors placed at the vertices of an equilateral triangle possesses unique advantage—with respect to line width variation due to pen rotation—over designs with two, four and six ejectors placed at the vertices of appropriate regular polygons.

Ejector configurations with an odd-number n of ejectors placed at the vertices of a regular polygon (with n vertices) possess a unique advantage over otherwise similar designs with even-numbered ejector counts of 2n or fewer.

It is to be understood that the ejectors referenced above are spaced relative to one another according to the configurations disclosed in the Powers Co-Pending Patent Application.

One aspect of the present invention is the addition of one or more interior ejectors. For an orientation-tolerant printhead with relatively few ejectors (e.g., one to twenty), a primary concern is the efficient use of spot area coverage. One is therefore prompted to consider ejector configurations that minimize spot size while sustaining line width capability. One way to reduce the required area-equivalent spot diameter, while retaining the established advantages of regular polygonal ejector configurations, is to add ejectors interior to the polygon's circumscribing circle.

We continue to use n to signify the number of ejectors configured at the vertices of the regular polygon. To this number we add q ejectors interior to the circumscribing circle of radius R. An ejector configuration of this type is denoted C(n,q). Of course, the polygon need not be perfectly regular; for example, the sides of the polygon may deviate from the average side length $s_{avg}$ by (say) no more than 20%. In the case of such a nearly regular polygon, the interior of the polygon may be taken to consist of points lying inside the polygon boundary—formed by the sides of the polygon. Although the greatest advantage accrues from adding ejectors near the center of the polygon, interior ejectors may be placed anywhere inside the polygonal boundary.

In practice, the configurations of most interest possess only a few ejectors; hence, the focus of this exemplary embodiment is hereafter narrowed to the case q=1 and we describe the benefit of adding a single ejector at the center of n ejectors placed at the vertices of a regular polygon. The configurations described in the Powers Co-Pending Patent Application and above of the present specification can be denoted C(n,0); those considered below are denoted C(n,1). Cases where q>1 can be treated in a fashion similar to that employed below.

As stated previously, only the overlap conditions require change. Recall that these are inequality conditions on the area-equivalent spot diameter d. which arise from geometrical considerations. They take the form:

$$d_{min}(n, q) \leqq d \leqq d^*(n, q).$$

The differences between the two cases (q=0 and q=1) are best illustrated by treating them in parallel. In their purely geometric form, the overlap conditions are expressed in the following series of inequalities:

| | | |
|---|---|---|
| q = 0: | $s \leqq d \leqq 2R$ | n = 2, 3, 4; |
| | $2t \leqq d \leqq 2R$ | n = 4, 5, 6, . . . |

Notice that s=2t tan(π/n); so that, in particular, s=2t at n=4.

| | | |
|---|---|---|
| q = 1: | $R \leqq d \leqq s$ | n = 2, 3, 4; |
| | $t \leqq d \leqq s$ | n = 5, 6; |
| | $t \leqq d \leqq R$ | n = 7, 8, 9, . . . |

As indicated for the case q=0 in the Powers Co-Pending Patent Application, the upper bounds expressed here reflect a geometric ideal; they are 'soft' in the sense that printed line quality degrades only gradually as spot diameter increases beyond the indicated magnitudes. In order to account for this physical reality, the cases where $d>d^*(n, q)$ can be characterized by introducing an experimentally determined coefficient λ, called the maximum spot diameter oversize ratio. It is the maximum value of the ratio $d/d^*$ that results in an ink-jetted line of acceptable quality. If $d^*(n, q)<d\leqq\lambda d^*(n, q)$ then spot overlap is moderately excessive. Spot diameters in this range may lead to a reduction of line edge crispness; but overall line quality remains acceptable. Only when $d>\lambda d^*(n, q)$ does line quality become unacceptable. We designate the new upper bound on spot diameter as $d_{max}(n, q)=\lambda d^*(n, q)$. For most combinations of ink and print media, the value of λ does not exceed 1.3.

With this modification to the upper bounds on spot diameter, the overlap conditions can be expressed in the form $d_{min}(n, q)\leqq d\leqq d_{max}(n, q)=\lambda d^*(n, q)$:

| | | |
|---|---|---|
| q = 0: | $s \leqq d \leqq 2\lambda R$ | n = 2, 3, 4; |
| | $2t \leqq d \leqq 2\lambda R$ | n = 4, 5, 6, . . . |
| q = 1: | $R \leqq d \leqq \lambda s$ | n = 2, 3, 4; |
| | $t \leqq d \leqq \lambda s$ | n = 5, 6; |
| | $t \leqq d \leqq \lambda R$ | n = 7, 8, 9, . . . |

These can be easily reduced in terms of the prescribed line width w using the relationships recorded above.

We find that:

$$d_{\min}(n, 0) = s = w/[1 + n/\pi] \qquad n = 2, 3, 4;$$
$$d_{\min}(n, 0) = 2t = w/[1 + (n/\pi)\tan(\pi/n)] \qquad n = 4, 5, 6, \ldots;$$
$$d_{\max}(n, 0) = 2\lambda R = \lambda w/[\lambda + (n/\pi)\sin(\pi/n)] \qquad n = 2, 3, 4, \ldots;$$

and $$d_{\min}(n, 1) = R = w/[1 + (2n/\pi)\sin(\pi/n)] \qquad n = 2, 3, 4;$$
$$d_{\min}(n, 1) = t = w/[1 + (2n/\pi)\tan(\pi/n)] \qquad n = 5, 6, 7, \ldots;$$

$$d_{max}(n, 1)=\lambda s=\lambda w/[\lambda+n/\pi] \quad n=2, 3, 4, 5, 6;$$

$$d_{max}(n, 1)=\lambda R=\lambda w/[\lambda+(2n/\pi)\sin(\pi/n)] \quad n=7, 8, 9,$$

The above expressions for $d_{min}$ and $d_{max}$ can be used to render the overlap conditions explicit in terms of n, q, and w for every $n\leqq 2$.

In order to exploit these conditions and to help assess the relative advantage of various ejector configurations, we introduce the following additional concepts. First, the total area K(n, q, d) of n+q ink spots of area-equivalent diameter d is given by $$K(n, q, d)=(n+q)\pi d^2.$$

The standard power law model relating area-equivalent spot diameter d to ejected drop mass M can be expressed in the form:

$$d=\kappa M^{\gamma}.$$

The coefficient κ and the exponent γ are to be experimentally determined for each ink and paper combination. It is more convenient here to work with the inverse form:

$$M=[d/\kappa]^{1/\gamma}.$$

When $d=d_{min}(n, q)$, we can write these in more expressive forms:

$$K_{min}(n, q)=(n+q)\pi[d_{min}(n, q)]_2,$$

$$M_{min}(n, q)=[d_{min}(n, q)/\kappa]^{1/\gamma}.$$

Entirely similar expressions can be defined when $d=d_{max}(n, q)$.

Comparisons between different configurations are more conveniently expressed in terms of ratios of d, K and M. Bearing this in mind, we introduce the following forms:

$$d=d_{min}: d(n, 1)/d(n', 0)|_{min},$$

$$d=d_{max}: d(n, 1)/d(n', 0)|_{max}.$$

$$K(n, 1)/K(n', 0)=((n+1)/n')[d(n, 1)/d(n', 0)]^2,$$

$$M(n, 1)/M(n', 0)=[d(n, 1)/d(n', 0)]^{1/\gamma}.$$

These ratios compare the ejector configurations C(n, 1) and C(n', 0) for a fixed line width w. Notice that the coefficient K need not be known and, while no single value of γ applies universally to all media, we are assured that 1/γ lies in the interval:

$$2\leqq 1/\gamma\leqq 3.$$

A typical value of 1/γ is 2.5—precisely the mid-point of this range.

We begin by comparing the configuration C(n, 1) with C(n, 0); that is, we examine the benefit of adding a single nozzle at the center of a regular polygon with n vertices. Hence, we set n'=n in the ratios above:

$$d=d_{min}: d(n, 1)/d(n, 0)|_{min},$$

$$d=d_{max}: d(n, 1)/d(n, 0)|_{max}.$$

$$K(n, 1)/K(n, 0)=(1+1/n)[d(n, 1)/d(n, 0)]^2,$$

$$M(n, 1)/M(n, 0)=[d(n, 1)/d(n, 0)]^{1/\gamma}.$$

Comparisons for various values of n can be found in the table below. The principle observation from these calculations is that the addition of an ejector at the center of a regular polygon significantly reduces the required spot diameter, with attendant decreases in total spot area and drop mass. Hence, the addition of an ejector at the center of a regular polygon leads to a significant improvement in line quality and a reduction in required ink mass.

| Comparisons Between C(n, 1) and C(n, 0) Ejector Configurations | | | | | | | | | | |
|---|---|---|---|---|---|---|---|---|---|---|
| gamma | 0.40 | 0.40 | 0.40 | 0.40 | 0.40 | 0.40 | 0.40 | 0.40 | 0.40 | 0.40 |
| 1/gamma | 2.50 | 2.50 | 2.50 | 2.50 | 2.50 | 2.50 | 2.50 | 2.50 | 2.50 | 2.50 |
| n | 2 | 3 | 4 | 5 | 6 | 7 | 8 | 9 | 10 | 11 |
| mod(n, 2) | 0 | 1 | 0 | 1 | 0 | 1 | 0 | 1 | 0 | 1 |
| phi(n) | 1.571 | 1.047 | 0.785 | 0.628 | 0.524 | 0.449 | 0.393 | 0.349 | 0.314 | 0.286 |
| psi(n) | 1.571 | 0.524 | 0.785 | 0.314 | 0.524 | 0.224 | 0.393 | 0.175 | 0.314 | 0.143 |
| beta(n) | 1 | 0.8660 | 1 | 0.9511 | 1 | 0.9749 | 1.000 | 0.9848 | 1.000 | 0.9898 |
| delta(n) | 1 | 0.116 | 0.293 | 0.047 | 0.134 | 0.024 | 0.076 | 0.015 | 0.049 | 0.010 |
| d = dmin: | | | | | | | | | | |
| d(n, 1)/d(n, 0) | 0.720 | 0.737 | 0.812 | 0.651 | 0.656 | 0.659 | 0.661 | 0.662 | 0.663 | |
| K(n, 1)/K(n, 0) | 0.518 | 0.543 | 0.659 | 0.424 | 0.430 | 0.434 | 0.437 | 0.438 | 0.439 | |
| M(n, 1)/M(n, 0) | 0.440 | 0.466 | 0.594 | 0.342 | 0.349 | 0.352 | 0.355 | 0.357 | 0.358 | |
| d = dmax: | | | | | | | | | | |
| d(n, 1)/d(n, 0) | 1.000 | 0.935 | 0.636 | 0.747 | 0.672 | 0.670 | 0.670 | 0.669 | 0.669 | |
| K(n, 1)/K(n, 0) | 1.000 | 0.873 | 0.699 | 0.558 | 0.451 | 0.449 | 0.445 | 0.447 | 0.447 | |
| M(n, 1)/M(n, 0) | 1.000 | 0.844 | 0.639 | 0.482 | 0.370 | 0.368 | 0.367 | 0.366 | 0.365 | |

Each column compares two configurations with n nozzles at the vertices of a regular polygon.
The C(n, 1) configuration has n nozzles at the vertices of a regular polygon and one nozzle at the polygon's center.
The C(n, 0) configuration has n nozzles at the vertices of a regular polygon and no interior nozzles.

Similar comparisons can be made between configurations with the same total number of ejectors. These are particularly useful when assessing drive pulse requirements. For example, if we set n'=n+1, then each ejector group under comparison involves n+1 ejectors. In this case, the above ratio formulae simplify as follows:

$$d=d_{min}: d(n, 1)/d(n+1, 0)|_{min},$$

$$d=d_{max}: d(n, 1)/d(n+1, 0)|_{max},$$

$$K(n, 1)/K(n+1, 0)=[d(n, 1)/d(n+1, 0)]^2,$$

$$M(n, 1)/M(n+1, 0)=[d(n, 1)/d(n+1, 0)]^{1/\gamma}.$$

Comparisons for various values of n can be found in the table below. Again, the principle observation is that (for n+q≧3) the addition of a nozzle at the center of a regular polygon—even at the expense of reducing the number of vertices by one—reduces the required spot diameter, with attendant decreases in spot area and drop mass. Hence, reducing by one the number of ejectors placed at the vertices of a regular polygon and shifting that ejector to the center of a new polygon with one fewer vertex improves line quality and decreases the required ink mass.

| Comparisons Between C(n, 1) and C(n + 1, 0) Ejector Configurations | | | | | | | | | | |
|---|---|---|---|---|---|---|---|---|---|---|
| gamma | 0.40 | 0.40 | 0.40 | 0.40 | 0.40 | 0.40 | 0.40 | 0.40 | 0.40 | 0.40 |
| 1/gamma | 2.50 | 2.50 | 2.50 | 2.50 | 2.50 | 2.50 | 2.50 | 2.50 | 2.50 | 2.50 |
| n | 2 | 3 | 4 | 5 | 6 | 7 | 8 | 9 | 10 | 11 |
| mock(n, 2) | 0 | 1 | 0 | 1 | 0 | 1 | 0 | 1 | 0 | 1 |
| phi(n) | 1.571 | 1.047 | 0.785 | 0.628 | 0.524 | 0.449 | 0.393 | 0.349 | 0.314 | 0.286 |
| psi(n) | 1.571 | 0.524 | 0.785 | 0.314 | 0.524 | 0.224 | 0.393 | 0.175 | 0.314 | 0.143 |
| beta(n) | 1 | 0.8660 | 1 | 0.9511 | 1 | 0.9749 | 1.000 | 0.9848 | 1.0000 | 0.9898 |
| delta(n) | 1 | 0.116 | 0.293 | 0.047 | 0.134 | 0.024 | 0.076 | 0.015 | 0.049 | 0.010 |
| d = dmin: | | | | | | | | | | |
| d(n + 1)/d(n + 1, 0) | 0.860 | 0.857 | 0.770 | 0.635 | 0.647 | 0.653 | 0.657 | 0.659 | 0.661 | |
| K(n, 1)/K(n + 1, 0) | 0.740 | 0.734 | 0.593 | 0.403 | 0.418 | 0.427 | 0.432 | 0.435 | 0.437 | |
| M(n, 1)/M(n + 1, 0) | 0.686 | 0.679 | 0.520 | 0.321 | 0.336 | 0.345 | 0.350 | 0.353 | 0.355 | |
| d = dmax: | | | | | | | | | | |
| d(n + 1)/d(n + 1, 0) | 1.116 | 0.972 | 0.851 | 0.681 | 0.676 | 0.673 | 0.671 | 0.670 | 0.669 | |
| K(n, 1)/K(n + 1, 0) | 1.246 | 0.945 | 0.725 | 0.464 | 0.457 | 0.451 | 0.451 | 0.449 | 0.446 | |
| M(n, 1)/M(n + 1, 0) | 1.317 | 0.932 | 0.669 | 0.383 | 0.376 | 0.372 | 0.369 | 0.358 | 0.367 | |

Each column compares two configurations with n + 1 nozzles.
The C(n + 1) configuration has n nozzles at the vertices of a regular polygon and one nozzle at the polygon's center.
The C(n + 1, 0) configuration has n + 1 nozzles at the vertices of a regular polygon and no interior nozzles.

The above observations prompt the following claims of invention:

The configuration of four ejectors: three placed at the vertices of an equilateral triangle and one at the center of said triangle, enjoys unique advantages—with respect to line width variation due to pen rotation and with respect to drop mass minimization—over any other configuration with two, three, four and five ejectors.

For any positive odd integer n, a configuration of n+1 ejectors, with n ejectors placed at the vertices of a regular polygon and one at the center of said polygon, enjoys unique advantages—with respect to line width variation due to pen rotation and with respect to drop mass minimization—over any otherwise similar configuration with even-numbered vertices.

As has been stated repeatedly, in applications where a line width is specified, these polygonal configurations are intended to conform to the rules described in the Powers Co-Pending Patent Application.

Given n and any member of the triple {R, s, t}, the other two members can be determined using well-known formulae:

$$s=2R\sin(\pi/n),$$

$$t=R\cos(\pi/n).$$

In what follows, we use the polygon side length s as a typical representative of the triple {R, s, t}.

Given n, q and any member of the triple {s, w, d}, the other two members can be confined to an interval using the overlap conditions (developed above) and the formula (derived in the Powers Co-Pending Patent Application):

$$d+(n/\pi)\sin(\pi/n)=w.$$

In yet another exemplary embodiment, n ranges from 2 to 20. In an alternative embodiment, n ranges from 2 to 6. In another exemplary embodiment, d ranges from about 20 μm to about 300 μm and w ranges from about 50 μm to about 2000 μm.

EXAMPLES

Example 1

The following tables illustrate exemplary embodiments of the present invention by way of numerical examples for maximum and minimum variation in line width of regular polygon nozzle configurations under rotation. In each case, the circumscribing circle is of constant unit diameter, n is the number of vertices of the regular polygon and dh(n) is the difference between maximum and minimum polygon widths. Table 3 sorted according to increasing number of vertices and Table 4 is sorted according to decreasing polygon width variations.

TABLE 3

| n | dh(n) |
|---|---|
| 2 | 1 |
| 3 | 0.1160 |
| 4 | 0.2929 |
| 5 | 0.0465 |
| 6 | 0.1340 |
| 7 | 0.0244 |
| 8 | 0.0761 |

TABLE 3-continued

| n | dh(n) |
|---|---|
| 9 | 0.0150 |
| 10 | 0.0489 |
| 11 | 0.0101 |
| 12 | 0.0341 |
| 13 | 0.0072 |

TABLE 4

| n | dh(n) |
|---|---|
| 2 | 1 |
| 4 | 0.2929 |
| 6 | 0.1340 |
| 3 | 0.1160 |
| 8 | 0.0761 |
| 10 | 0.0489 |
| 5 | 0.0465 |
| 12 | 0.0341 |
| 7 | 0.0244 |
| 9 | 0.0150 |
| 11 | 0.0101 |
| 13 | 0.0072 |

Example 2

The following table illustrates exemplary embodiments of the present invention by way of numerical examples for nozzle counts n=2, 3, . . . 11, with each column devoted a specified value of n. The elements of the first column identify the contents of the corresponding row by the names or symbols introduced above. The numerical values occupying the body of the table are computed using the formulae introduced above. The top portion of the table contains values of w, n, mod (n, 2), ϕ(n), ψ(n) and β(n) and δ(n)(=delta(n)) common to the lower parts of the table.

The second portion of the table exemplifies data for q=0 as disclosed in the Powers Co-Pending Patent Application. It contains values of d, s, 2R, 2t, h* and of the difference h(ψ)−h(0) corresponding to the lower bound of spot diameter d. The difference h(ψ)−h(0) (=2Rδ(n)) represents the difference in line-width expected due to pen body rotation. Lastly the second portion of the table summarizes values of $d_{min}$, d* and $d_{max}=\lambda d^*$ for a maximum spot diameter oversize ratio λ equal to 1.3 .

The third portion of the table exemplifies results for q=1. It contains values of d, s, 2R, 2t, h* and of the difference h(ψ)−h(0))(=2Rδ(n)) corresponding to the optimum spot diameter d=d*. Lastly the third portion of the table summarizes values of $d_{min}$, d* and $d_{max}=\lambda d^*$ for a maximum spot diameter oversize ratio λ equal to 1.3.

Relationships Between n, q, Spot Diameter, et cetera
Numerical Example with easily scalable line-width

| lambda = | 1.3 | | | | | | | | | |
|---|---|---|---|---|---|---|---|---|---|---|
| w | 100 | 100 | 100 | 100 | 100 | 100 | 100 | 100 | 100 | 100 |
| n | 2 | 3 | 4 | 5 | 6 | 7 | 8 | 9 | 10 | 11 |
| mod(n, 2) | 0 | 1 | 0 | 1 | 0 | 1 | 0 | 1 | 0 | 1 |
| phi(n) | 1.571 | 1.047 | 0.785 | 0.628 | 0.524 | 0.449 | 0.393 | 0.349 | 0.314 | 0.286 |
| psi(n) | 1.571 | 0.524 | 0.785 | 0.314 | 0.524 | 0.224 | 0.393 | 0.175 | 0.314 | 0.143 |
| beta(n) | 1 | 0.866 | 1 | 0.951 | 1 | 0.975 | 1 | 0.985 | 1 | 0.990 |
| delta(n) | 1 | 0.116 | 0.293 | 0.047 | 0.134 | 0.024 | 0.076 | 0.015 | 0.049 | 0.010 |
| q | 0 | 0 | 0 | 0 | 0 | 0 | 0 | 0 | 0 | 0 |

-continued

Relationships Between n, q, Spot Diameter, et cetera
Numerical Example with easily scalable line-width

| | | | | | | | | | | |
|---|---|---|---|---|---|---|---|---|---|---|
| d = s | dmin | dmin | dmin | | | | | | | |
| s(n, q) | 61.1 | 51.2 | 44.0 | | | | | | | |
| 2R(n, q) | 61.1 | 59.1 | 62.2 | | | | | | | |
| h*(n, q) | 38.9 | 48.8 | 56.0 | | | | | | | |
| 2R delta(n) | 61.1 | 6.9 | 18.2 | | | | | | | |
| d(n, q) | 61.1 | 51.2 | 44.0 | | | | | | | |
| d = 2t | | | dmin | dmin | dmin | dmin | dmin | dmin | dmin | dmin |
| 2t(n, q) | | | 44.0 | 46.4 | 47.6 | 48.2 | 48.7 | 49.0 | 49.2 | 49.3 |
| 2R(n, q) | | | 62.2 | 57.3 | 54.9 | 53.5 | 52.7 | 52.1 | 51.7 | 51.4 |
| s(n, q) | | | 44.0 | 33.7 | 27.5 | 23.2 | 20.2 | 17.8 | 16.0 | 14.5 |
| h*(n, q) | | | 56.0 | 53.6 | 52.4 | 51.8 | 51.3 | 51.0 | 50.8 | 50.7 |
| 2R delta(n) | | | 18.2 | 2.7 | 7.4 | 1.3 | 4.0 | 0.8 | 2.5 | 0.5 |
| d(n, q) | | | 44.0 | 46.4 | 47.6 | 48.2 | 48.7 | 49.0 | 49.2 | 49.3 |
| d = 2R: | d* | d* | d* | d* | d* | d* | d* | d* | d* | d* |
| 2R(n, q) | 61.1 | 54.7 | 52.6 | 51.7 | 51.2 | 50.8 | 50.6 | 50.5 | 50.4 | 50.3 |
| s(n, q) | 61.1 | 47.4 | 37.2 | 30.4 | 25.6 | 22.1 | 19.4 | 17.3 | 15.6 | 14.2 |
| h*(n, q) | 38.9 | 45.3 | 47.4 | 48.3 | 48.8 | 49.2 | 49.4 | 49.5 | 49.6 | 49.7 |
| 2R delta(n) | 61.1 | 6.4 | 15.4 | 2.4 | 6.9 | 1.2 | 3.9 | 0.8 | 2.5 | 0.5 |
| d(n,q) | 61.1 | 54.7 | 52.6 | 51.7 | 51.2 | 50.8 | 50.6 | 50.5 | 50.4 | 50.3 |
| dmin | 61.1 | 51.2 | 44.0 | 46.4 | 47.6 | 48.2 | 48.7 | 49.0 | 49.2 | 49.3 |
| d* | 61.1 | 54.7 | 52.6 | 51.7 | 51.2 | 50.8 | 50.6 | 50.5 | 50.4 | 50.3 |
| dmax | 79.4 | 71.2 | 68.4 | 67.2 | 66.5 | 66.1 | 65.8 | 65.7 | 65.5 | 65.4 |
| q | 1.0 | 1.0 | 1.0 | 1.0 | 1.0 | 1.0 | 1.0 | 1.0 | 1.0 | 1.0 |
| d = R: | dmin | dmin | dmin | | | d* | d* | d* | d* | d* |
| R(n, q) | 44.0 | 37.7 | 35.7 | | | 34.1 | 33.9 | 33.8 | 33.7 | 33.6 |
| 2R(n, q) | 88.0 | 75.4 | 71.4 | | | 68.2 | 67.8 | 67.6 | 67.4 | 67.3 |
| s(n, q) | 88.0 | 65.3 | 50.5 | | | 29.6 | 26.0 | 23.1 | 20.8 | 19.0 |
| h*(n, q) | 56.0 | 62.3 | 64.3 | | | 65.9 | 66.1 | 66.2 | 66.3 | 66.4 |
| 2R delta(n) | 88.0 | 8.7 | 20.9 | | | 1.7 | 5.2 | 1.0 | 303 | 0.7 |
| d(n, q) | 44.0 | 37.7 | 35.7 | | | 34.1 | 33.9 | 33.8 | 33.7 | 33.6 |
| d = t: | | | | dmin | dmin | dmin | dmin | dmin | dmin | dmin |
| t(n, q) | | | | 30.2 | 31.2 | 31.8 | 32.2 | 32.4 | 32.6 | 32.7 |
| 2R(n, q) | | | | 74.6 | 72.0 | 70.6 | 69.6 | 69.0 | 68.5 | 68.2 |
| s(n, q) | | | | 43.9 | 36.0 | 30.6 | 26.6 | 23.6 | 21.2 | 19.2 |
| h*(n, q) | | | | 69.8 | 68.8 | 68.2 | 67.8 | 67.6 | 67.4 | 67.3 |
| 2R delta(n) | | | | 3.5 | 9.7 | 1.7 | 5.3 | 1.0 | 3.4 | 0.7 |
| d(n, q) | | | | 30.2 | 31.2 | 31.8 | 32.2 | 32.4 | 32.6 | 32.7 |
| d = s: | d* | d* | d* | d* | d* | | | | | |
| s(n, q) | 61.1 | 51.2 | 44.0 | 38.6 | 34.4 | | | | | |
| 2R(n, q) | 61.1 | 59.1 | 62.2 | 65.6 | 68.7 | | | | | |
| h*(n, q) | 38.9 | 48.8 | 56.0 | 61.4 | 65.6 | | | | | |
| 2R delta(n) | 61.1 | 6.9 | 18.2 | 3.1 | 9.2 | | | | | |
| d(n, q) | 61.1 | 51.2 | 44.0 | 38.6 | 34.4 | | | | | |
| dmin | 44.0 | 37.7 | 35.7 | 30.2 | 31.2 | 31.8 | 32.2 | 32.4 | 32.6 | 32.7 |
| d* | 61.1 | 51.2 | 44.0 | 38.6 | 34.4 | 34.1 | 33.9 | 33.8 | 33.7 | 33.6 |
| dmax | 79.4 | 66.5 | 57.2 | 50.2 | 44.7 | 44.3 | 44.1 | 43.9 | 43.8 | 43.7 |

The foregoing description of the various embodiments and principles of the invention has been presented for the purposes of illustration and description. It is not intended to be exhaustive or to limit the invention to the precise forms disclosed. Many alternatives, modifications and variations will be apparent to those skilled in the art. For example, some principals of the invention may be used in different ink jet print head configurations. Moreover, although multiple inventive concepts have been presented, such aspects need not be utilized in combination, and various combinations of inventive aspects are possible in light of the various embodiments provided above. Accordingly, the above description is intended to embrace all possible alternatives, modifications, combinations, and variations that have been discussed or suggested herein, as well as all others that fall within the principals, spirit and broad scope of the invention as defined by the claims.

What I claim is:

1. An ink jet print head adapted to minimize orientation-induced line-width variation, the print head comprising:

n+q nozzles, wherein n nozzles are located at vertices of a polygon having an average side length $s_{avg}$ and q nozzles are located inside the boundary of said polygon, and wherein each side length of the polygon is less than 20% deviation from the average side length $s_{avg}$;

wherein the n+q nozzles are configured to ink jet a line having a line-width w; and wherein each of the n+q nozzles is configured to ink jet a spot having an average area-equivalent spot diameter d which satisfies the inequality conditions (I)

$$0.7w \leqq d+(n/\pi)s_{avg} \leqq 1.3w \quad \text{(I).}$$

2. The ink jet print head of claim 1, wherein the polygon is a regular polygon.

3. The ink jet print head of claim 1, wherein q=1.

4. The ink jet print head of claim 1, wherein n ranges from 3 to 10.

5. The ink jet print head of claim 1, wherein n ranges from 3 to 6.

6. The ink jet print head of claim 1, wherein d ranges from about 20 μm to about 300 μm.

7. The ink jet print head of claim 1, wherein w ranges from about 50 μm to about 2000 μm.

8. An ink jet print head adapted to minimize orientation-induced line-width variation, the print head comprising:

n+1 nozzles, wherein the n+1 nozzles are configured to ink jet a line having a line-width w; and wherein n nozzles are located at vertices of a polygon having an average side length $s_{avg}$ and one nozzle is located inside the polygon boundary, and wherein each side length of the polygon is less than 20% deviation from the average side length $s_{avg}$;

wherein each of the n+1 nozzles is configured to ink jet a spot having an average area-equivalent spot diameter d which satisfies the inequality conditions (IIa, IIb, IIc) with coefficient λ=1.3:

$$\tfrac{1}{2}s_{avg}\csc(\pi/n)\leqq d\leqq\lambda s_{avg} \text{ when } n=2,3,4 \quad \text{(IIa)},$$

$$\tfrac{1}{2}s_{avg}\cot(\pi/n)\leqq d\leqq\lambda s_{avg} \text{ when } n=5,6 \quad \text{(IIb)},$$

and $$\tfrac{1}{2}s_{avg}\cot(\pi/n)\leqq d\leqq\tfrac{1}{2}\lambda s_{avg}\csc(\pi/n) \text{ when } n=7,8,9, \quad \text{(IIc)}.$$

9. The ink jet print head of claim 8, wherein the polygon is a regular polygon and the one nozzle located inside the polygon boundary lies at the center of the regular polygon.

10. An ink jet print head adapted to minimize orientation-induced line-width variation, the print head comprising:

n+1 nozzles, wherein the n+1 nozzles are configured to ink jet a line having a line-width w; and wherein n nozzles are located at vertices of a polygon having an average side length $s_{avg}$ and one nozzle is located inside the polygon boundary, and wherein each side length of the polygon is less than 20% deviation from the average side length $s_{avg}$;

wherein the n+1 nozzles are configured to ink jet a polygonal array of ink spots having an average area-equivalent spot diameter d which satisfies the inequality conditions (IIIa, IIIb, IIIc) with coefficient λ=1.3:

$$w/[1+(2n/\pi)\sin(\pi/n)]\leqq d\leqq\lambda w/[\lambda+n/\pi], \text{ where } n=2,3,4 \quad \text{(IIIa)},$$

$$w/[1+(2n/\pi)\tan(\pi/n)]\leqq d\leqq\lambda w/[\lambda+n/\pi], \text{ where } n=5,6 \quad \text{(IIIb)},$$

and $$w/[1+(2n/\pi)\tan(\pi/n)]\leqq d\leqq\lambda w/[\lambda+(2n/\pi)\sin(\pi/n)], \text{ where } n=7,8,9, \quad \text{(IIIc)}.$$

11. The ink jet print head of claim 10, wherein the polygon is a regular polygon and the one nozzle located inside the polygon boundary lies at the center of the regular polygon.

12. An ink jet print head adapted to minimize orientation-induced line-width variation, the print head comprising:

n+1 nozzles, wherein n nozzles are located at vertices of a polygon having an average side length $s_{avg}$ and one nozzle is located inside the polygon boundary, and wherein each side length of the polygon is less than 20% deviation from the average side length $s_{avg}$ which satisfies the inequality conditions (IVa, IVb, IVc) with coefficient λ=1.3:

$$w/[\lambda+n/\pi]\leqq s_{avg}\leqq 2w\sin(\pi/n)/[1+(2n/\pi)\sin(\pi/n)], \text{ where } n=2,3,4 \quad \text{(IVa)},$$

$$w/[\lambda+n/\pi]\leqq s_{avg}\leqq 2w\tan(\pi/n)/[1+(2n/\pi)\tan(\pi/n)], \text{ where } n=5,6 \quad \text{(IVb)},$$

and $$2w\sin(\pi/n)/[\lambda+(2n/\pi)\sin(\pi/n)]\leqq s_{avg}\leqq 2w\tan(\pi/n)/[1+(2n/\pi)\tan(\pi/n)], \text{ where } n=7,8,9, \quad \text{(IVc)}.$$

13. The ink jet print head of claim 12, wherein the polygon is a regular polygon and the one nozzle located inside the polygon boundary lies at the center of the regular polygon.

14. An ink jet print head adapted to minimize orientation-induced line-width variation, the print head comprising:

n+1 nozzles, wherein n nozzles are located at vertices of a polygon having an average side length $s_{avg}$ and one nozzle is located inside the polygon boundary, and wherein each side length of the polygon is less than 20% deviation from the average side length $s_{avg}$;

wherein each of the n+1 nozzles is configured to ink jet a line having a line width w which satisfies the inequality conditions (Va, Vb, Vc) with coefficient λ=1.3:

$$[n/\pi+\tfrac{1}{2}\csc(\pi/n)]s_{avg}\leqq w\leqq[\lambda+n/\pi]s_{avg}, \text{ where } n=2,3,4 \quad \text{(Va)},$$

$$[n/\pi+\tfrac{1}{2}\cot(\pi/n)]s_{avg}\leqq w\leqq[\lambda+n/\pi]s_{avg}, \text{ where } n=5,6 \quad \text{(Vb)},$$

and $$[n/\pi+\tfrac{1}{2}\cot(\pi/n)]s_{avg}\leqq w\leqq[n/\pi+\tfrac{1}{2}\lambda\csc(\pi/n)]s_{avg}, \text{ where } n=7,8,9, \quad \text{(Vc)}.$$

15. An ink jet print head adapted to minimize orientation-induced line-width variation, the print head comprising:

n+1 nozzles, wherein n nozzles are located at vertices of a polygon having an average side length $s_{avg}$ and one nozzle is located inside the polygon boundary and configured for ink jetting a polygonal array of ink spots having an average area-equivalent spot diameter d; and wherein each side length of the polygon is less than 20% deviation from the average side length $s_{avg}$ which satisfy the inequality conditions (VIa, VIb, VIc) with coefficient)λ=1.3:

$$d/\lambda\leqq s_{avg}\leqq 2d\sin(\pi/n), \text{ where } n=2,3,4 \quad \text{(VIa)},$$

$$d/\lambda\leqq s_{avg}\leqq 2d\tan(\pi/n), \text{ where } n=5,6 \quad \text{(VIb)},$$

and $$(2d/\lambda)\sin(\pi/n)\leqq s_{avg}\leqq 2d\tan(\pi/n), \text{ where } n=7,8,9, \quad \text{(VIc)}.$$

16. An ink jet print head adapted to minimize orientation-induced line-width variation, the print head comprising:

n+1 nozzles, wherein n nozzles are located at vertices of a polygon having an average side length $s_{avg}$ and one nozzle is located inside the polygon boundary, and wherein each side length of the polygon is less than 20% deviation from the average side length $s_{avg}$; and configured for ink jetting a polygonal array of ink spots having an average area-equivalent spot diameter d; and wherein each of the n+1 nozzles is configured to ink jet a line having a line width w which satisfies the inequality conditions (VIIa, VIIb, VIIc) with coefficient λ=1.3:

$$[1+(n/\pi\lambda)]d \leqq w \leqq [1+(2n/\pi)\sin(\pi/n)]d, \text{ where } n=2, 3, 4 \quad \text{(VIIa)},$$

$$[1+(n/\pi\lambda)]d \leqq w \leqq [1+(2n/\pi)\tan(\pi/n)]d, \text{ where } n=5, 6 \quad \text{(VIIb), and}$$

$$[1+(2n/\pi)\sin(\pi/n)]d \leqq w \leqq [1+(2n/\pi)\tan(\pi/n)]d, \text{ where } n=7, 8, 9, \quad \text{(VIIc)}.$$

17. An ink jet print head adapted to minimize orientation-induced line-width variation, the print head comprising:

n+q nozzles, wherein the n nozzles are located at vertices of a regular polygon and q nozzles are located inside the boundary of the regular polygon;

wherein n ranges from 2 to 30 and q ranges from about 0 to 8.

18. The ink jet print head of claim 17, wherein n=3 and q=0.

19. The ink jet print head of claim 17, wherein n=3 and q=1.

20. The ink jet print head of claim 17, wherein n is an odd integer and n≧3.

* * * * *